US008552934B2

(12) United States Patent
Lee et al.

(10) Patent No.: US 8,552,934 B2
(45) Date of Patent: Oct. 8, 2013

(54) ORGANIC LIGHT EMITTING DISPLAY AND METHOD OF DRIVING THE SAME

(75) Inventors: Wang-Jo Lee, Suwon-si (KR); Sang-Moo Choi, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 718 days.

(21) Appl. No.: 12/424,299

(22) Filed: Apr. 15, 2009

(65) Prior Publication Data

US 2009/0295782 A1 Dec. 3, 2009

(30) Foreign Application Priority Data

May 28, 2008 (KR) ..... 10-2008-0049709

(51) Int. Cl.
*G09G 3/30* (2006.01)

(52) U.S. Cl.
USPC ..... 345/76; 315/169.3

(58) Field of Classification Search
USPC ..... 345/76–83; 315/169.3; 257/59
See application file for complete search history.

(56) References Cited

U.S. PATENT DOCUMENTS

| | | | | |
|---|---|---|---|---|
| 5,422,658 | A * | 6/1995 | Kawaguchi et al. | 345/213 |
| 6,603,454 | B1 * | 8/2003 | Nakamura et al. | 345/97 |
| 6,989,876 | B2 * | 1/2006 | Song et al. | 349/109 |
| 7,471,274 | B2 * | 12/2008 | Kim | 345/88 |
| 7,483,096 | B2 * | 1/2009 | Roh et al. | 349/106 |
| 7,701,476 | B2 * | 4/2010 | Brown Elliott et al. | 345/694 |
| 7,812,800 | B2 * | 10/2010 | Peng et al. | 345/83 |
| 7,898,623 | B2 * | 3/2011 | Kimura et al. | 349/129 |
| 2002/0180670 | A1 * | 12/2002 | Kim | 345/76 |
| 2003/0085340 | A1 * | 5/2003 | Street | 250/208.1 |
| 2004/0233185 | A1 * | 11/2004 | Hashimoto et al. | 345/204 |
| 2005/0231447 | A1 * | 10/2005 | Hu et al. | 345/76 |
| 2006/0061531 | A1 * | 3/2006 | Park et al. | 345/88 |
| 2006/0071221 | A1 * | 4/2006 | Park et al. | 257/89 |
| 2007/0013619 | A1 * | 1/2007 | Watanabe et al. | 345/76 |
| 2007/0091050 | A1 * | 4/2007 | Katayama et al. | 345/98 |
| 2010/0283776 | A1 * | 11/2010 | Park et al. | 345/211 |
| 2011/0017994 | A1 * | 1/2011 | Kuo et al. | 257/59 |

FOREIGN PATENT DOCUMENTS

| | | |
|---|---|---|
| JP | 2008-051959 | 3/2008 |
| KR | 10-2005-0031945 | 4/2005 |
| KR | 10-2006-0004393 | 1/2006 |
| KR | 10-0626069 | 9/2006 |

(Continued)

OTHER PUBLICATIONS

KIPO Office action dated Aug. 27, 2009, for priority Korean application 10-2008-0049709, noting listed reference in this IDS.

(Continued)

*Primary Examiner* — Dmitriy Bolotin
(74) *Attorney, Agent, or Firm* — Christie, Parker & Hale, LLP

(57) ABSTRACT

An organic light emitting display and a driving method thereof that reduces false contour noise and the occurrence of a stripe pattern generated in a digital driving manner. The organic light emitting display includes a scan driver for supplying a scan signal to scan lines, a data driver for supplying a data signal to data lines, and pixels coupled to the scan lines and the data lines. Each of the pixels includes an organic light emitting diode. The organic light emitting diodes of the pixels coupled to a scan line are alternately positioned in a first horizontal line and a second horizontal line adjacent to the first horizontal line, respectively.

14 Claims, 4 Drawing Sheets

(56) References Cited

FOREIGN PATENT DOCUMENTS

| | | |
|---|---|---|
| KR | 10-2008-0002331 | 1/2008 |
| KR | 10-2008-0042320 | 5/2008 |
| KR | 10-2008-0056944 | 6/2008 |

OTHER PUBLICATIONS

KIPO Office action dated Oct. 30, 2009, for priority Korean application 10-2008-0049709, noting listed references in this IDS, as well as JP 2008-051959 previously filed in an IDS dated Nov. 18, 2009.

* cited by examiner

ORGANIC LIGHT EMITTING DISPLAY AND METHOD OF DRIVING THE SAME

CROSS-REFERENCE TO RELATED APPLICATIONS

This application claims priority to and the benefit of Korean Patent Application No. 10-2008-0049709, filed on May 28, 2008, in the Korean Intellectual Property Office, the entire content of which is incorporated herein by reference.

BACKGROUND OF THE INVENTION

1. Field of the Invention

The present invention relates to an organic light emitting display and a method of driving the same.

2. Description of Related Art

Recently, there have been various types of flat panel display devices with reduced weight and volume in comparison to cathode ray tube display devices. The flat panel display devices can be categorized as a liquid crystal display, a field emission display, a plasma display panel, an organic light emitting display, and the like.

Among these flat panel display devices, the organic light emitting display displays images using organic light emitting diodes (OLEDs) that emit light through the recombination of electrons and holes. The organic light emitting display device has a fast response speed and a low power consumption.

Generally, pixels of an organic light emitting display device display images by charging a predetermined voltage in a storage capacitor included in each of the pixels and supplying a current corresponding to the charged voltage to an OLED (an analog driving manner). However, in such a driving method (or manner), there is a limit to the number of gray levels because expressing a large number of gray levels requires the use of a large number of different voltages stored in the storage capacitor. Further, it is difficult to display a uniform image due to variations on the threshold voltage and mobility of a driving transistor included in each of the pixels.

In order to solve these problems, there has been proposed a digital driving manner. In the digital driving manner, a data signal corresponding to turn-on or turn-off is supplied to each pixel, and turn-on times of the pixels are controlled during a plurality of sub-frame periods included in one frame, thereby expressing a gray level. However, in the digital driving manner, a gray level is expressed according to a light emitting time of the pixels. For this reason, false contour noise is generated while a moving image is displayed.

In order to reduce such false contour noise, a method of driving even-numbered and odd-numbered scan lines at a time difference of ½ frame has been proposed in Korean Patent Application No. 2006-0110571. In Korean Patent Application No. 2006-0110571, when pixels coupled to the even-numbered scan lines are driven, pixels coupled to the odd-numbered scan lines are then driven after ½ frame. As such, if the pixels coupled to the even-numbered and odd-numbered scan lines are driven at a time difference of ½ frame, images having different weight values are displayed between adjacent lines. Accordingly, false contour noise can be reduced without an increase in number of sub-frames.

However, when the pixels coupled to the even-numbered and odd-numbered scan lines are driven at a time difference of ½ frame, line-shaped noise may be additionally generated.

SUMMARY OF THE INVENTION

Accordingly, it is an aspect of the present invention to provide an organic light emitting display and a method of driving the same that reduces false contour noise and the occurrence of a stripe generated in a digital driving manner.

According to an embodiment of the present invention, an organic light emitting display includes: a scan driver for supplying a scan signal to scan lines; a data driver for supplying a data signal to data lines; and pixels coupled to the scan lines and the data lines. Each of the pixels has corresponding organic light emitting diodes. The organic light emitting diodes of first pixels and second pixels of said pixels coupled to a scan line of the scan lines are alternately positioned in a first horizontal line and a second horizontal line adjacent to the first horizontal line, respectively.

The data driver may be configured to supply the data signal corresponding to the first horizontal line to corresponding data lines of the data lines coupled to the first pixels, and may supply the data signal corresponding to the second horizontal line to corresponding data lines of the data lines coupled to the second pixels when the scan signal is supplied to the scan line. The data signal may be a first data signal with which the pixels emit light or a second data signal with which the pixels do not emit light. A source/drain metal of a driving transistor included in each of the first pixels for supplying a current to a corresponding one of the organic light emitting diodes may be electrically coupled to an anode electrode of the organic light emitting diode positioned on the first horizontal line through a contact hole. The organic light emitting display may further include a timing controller for rearranging received data and supplying the rearranged data to the data driver so that the data signal corresponding to the first horizontal line and the data signal corresponding to the second horizontal line are supplied from the data driver in accordance with the rearranged data. The scan lines may include odd-numbered scan lines and even-numbered scan lines, which are driven at a time difference of ½ frame.

According to another embodiment of the present invention, a driving method of an organic light emitting display is provided. The display has pixels coupled to data lines and scan lines, and each of the pixels includes at least one organic light emitting diode. The method includes: while supplying a scan signal to a scan line of the scan lines, supplying a data signal to first pixels of the pixels that are coupled to the scan line and have their organic light emitting diodes positioned on a first horizontal line; and while supplying the scan signal to the scan line, supplying another data signal to second pixels of the pixels that are coupled to the scan line and have their organic light emitting diodes positioned on a second horizontal line.

The organic light emitting diodes of the first pixels and the organic light emitting diodes of the second pixels may be alternately arranged between the first horizontal line and the second horizontal line. The data signal may be a first data signal with which the pixels emit light or a second data signal with which the pixels do not emit light. One frame may be divided into a plurality of sub-frames, and the scan lines may include odd-numbered scan lines and even-numbered scan lines, which are driven at a time difference of ½ frame.

According to an embodiment of the present invention, an organic light emitting display includes: a plurality of scan lines having odd-numbered scan lines and even-numbered scan lines configured to be driven at a time difference of ½ frame; and a plurality of pixels coupled to a scan line of the plurality of scan lines, first pixels of the plurality of pixels having first organic light emitting diodes positioned on a first horizontal line and second pixels of the plurality of pixels having second organic light emitting diodes positioned on a second horizontal line adjacent to the first horizontal line.

The first organic light emitting diodes and the second organic light emitting diodes may be alternately arranged between the first horizontal line and the second horizontal line. A pixel of the plurality of pixels may include sub-pixels, and each of the sub-pixels may have an organic light emitting diode positioned on a same horizontal line.

According to an embodiment of the present invention, a method is provided for driving an organic light emitting display having a plurality of pixels coupled to a scan line and a data line. The method includes: supplying a scan signal to the scan line; supplying a first data signal to a first pixel of the pixels, the first pixel having an organic light emitting diode positioned on a first horizontal line; and supplying a second data signal to a second pixel of the pixels, the second pixel having another organic light emitting diode positioned on a second horizontal line adjacent to the first horizontal line. A pixel of the plurality of pixels may include sub-pixels, and each of the sub-pixels may have an organic light emitting diode positioned on a same horizontal line.

In an organic light emitting display and a driving method thereof according to embodiments of the present invention, when even-numbered and odd-numbered scan lines are driven at a time difference of ½ frame, pixels emit light in a mosaic form, and therefore, line-shaped noise can be prevented or reduced. Further, if the pixels emit light in a mosaic form, false contour noise can be reduced.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION OF EXEMPLARY EMBODIMENTS

Figure 1:
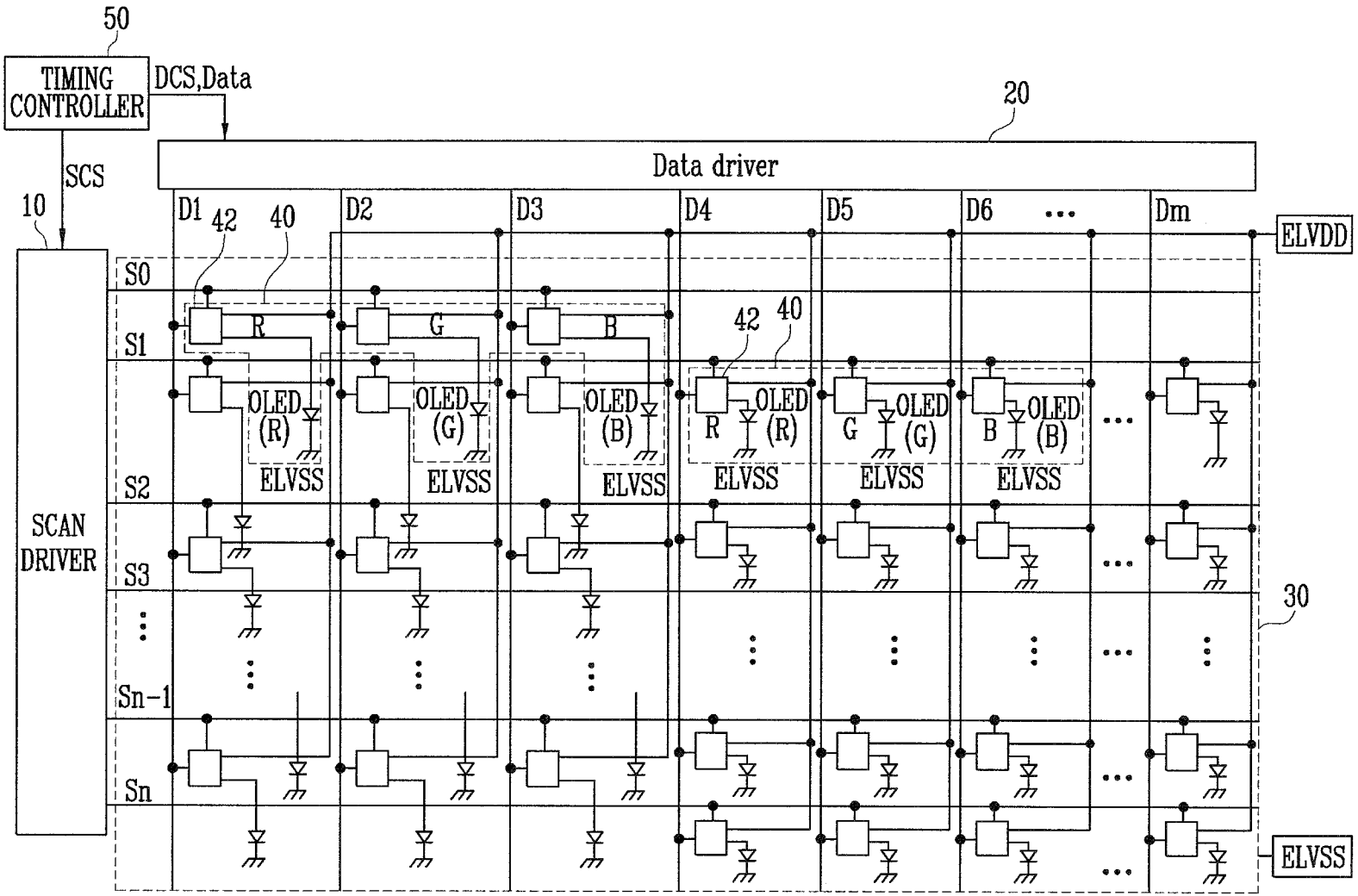
FIG. 1 shows a schematic block diagram of an organic light emitting display according to an embodiment of the present invention.

Hereinafter, certain exemplary embodiments according to the present invention will be described with reference to the accompanying drawings. Here, when a first element is described as being coupled to a second element, the first element may be directly coupled to the second element or may be indirectly coupled to the second element via a third element. Further, some of the elements that are not essential to a complete understanding of the present invention are omitted for clarity. Also, like reference numerals refer to like elements throughout.

FIG. 1 shows an organic light emitting display according to an embodiment of the present invention.

Referring to FIG. 1, the organic light emitting display according to the embodiment of the present invention includes a display unit 30 including pixels 40 positioned at crossing portions of scan lines S0 to Sn and data lines D1 to Dm; a scan driver 10 for driving the scan lines S0 to Sn; a data driver 20 for driving the data lines D1 to Dm; and a timing controller 50 for controlling the scan driver 10 and the data driver 20.

The display unit 30 supplies a first power ELVDD and a second power ELVSS, supplied from the outside, to the pixels 40. The pixels 40, to which the first power ELVDD and the second power ELVSS are supplied, display an image (e.g., a predetermined image) while emitting or not emitting light in response to a data signal.

Here, each of the pixels 40 includes a red sub-pixel R, a green sub-pixel G and a blue sub-pixel B. The red sub-pixel R includes a red organic light emitting diode OLED(R) for emitting red light and a pixel circuit 42 for controlling whether or not a current is supplied to the red organic light emitting diode OLED(R). The green sub-pixel G includes a green organic light emitting diode OLED(G) for emitting green light and a pixel circuit 42 for controlling whether or not a current is supplied to the green organic light emitting diode OLED(G). The blue sub-pixel B includes a blue organic light emitting diode OLED(B) for emitting blue light and a pixel circuit 42 for controlling whether or not a current is supplied to the blue organic light emitting diode OLED(B).

In an embodiment of the present invention, pixels 40 coupled to the same scan line S (e.g., S0 to Sn) are arranged so that their organic light emitting diodes OLEDs are alternately positioned on different horizontal lines. More specifically, organic light emitting diodes OLEDs of some pixels 40 coupled to an i-th (i is a natural number) scan line Si are arranged in an (i+1)-th horizontal line, and organic light emitting diodes OLEDs of the other pixels 40 alternately arranged with the some pixels 40 are arranged in an i-th horizontal line.

For example, in FIG. 1, organic light emitting diodes OLED(R), OLED(G) and OLED(B) of sub-pixels R, G and B included in a pixel 40 coupled to the first scan line S1 and the first to third data lines D1 to D3 are positioned on the (i+1)-th horizontal line. Organic light emitting diodes OLED(R), OLED(G) and OLED(B) of sub-pixels R, G and B included in a pixel 40 coupled to the first scan line S1 and the fourth to sixth data lines D4 to D6 are positioned on the i-th horizontal line.

The scan driver 10 supplies a scan signal of a low level to the scan lines S1 to Sn during a plurality of sub-frame periods included in one frame. Here, even-numbered scan lines and odd-numbered scan lines are driven at a time difference of ½ frame. Therefore, the scan driver 10 sequentially supplies a scan signal to the even-numbered scan lines S2, S4, etc. or the odd-numbered scan lines S1, S3, etc. during a scan period of each of the sub-frames.

The data driver 20 generates data signals using data supplied from the timing controller 50. The data driver 20 supplies the generated data signals to the data lines D1 to Dm whenever a scan signal is supplied. Here, the data signals can be categorized into a first data signal with which pixels emit light and a second data signal with which pixels do not emit light.

The data driver 20 supplies corresponding data signals to organic light emitting diodes OLEDs positioned on different horizontal lines for each of the pixels 40. For example, the data driver 20 supplies a data signal corresponding to the (i+1)-th horizontal line to pixels 40 which are coupled to an i-th scan line Si and have organic light emitting diodes OLEDs positioned in the (i+1)-th horizontal line. The data driver 20 supplies a data signal corresponding to the i-th horizontal line to pixels 40 which are coupled to the i-th scan line Si and have organic light emitting diodes OLED positioned in the i-th horizontal line.

For example, when a scan signal is supplied to the first scan line S1, the data driver 20 supplies a data signal corresponding to a second horizontal line to the first to third data lines D1 to D3, and supplies a data signal corresponding to a first horizontal line to the fourth to sixth data lines D4 to D6.

The timing controller 50 generates a data driving control signal DCS and a scan driving control signal SCS corresponding to synchronization signals supplied from the outside. The data driving control signal DCS generated from the timing controller 50 is supplied to the data driver 20, and the scan driving control signal SCS generated from the timing controller 50 is supplied to the scan driver 10. The timing controller 50 rearranges data and supplies the rearranged data to the data driver 20 so that data signals corresponding to different horizontal lines are supplied from the data driver 20.

Figure 2:
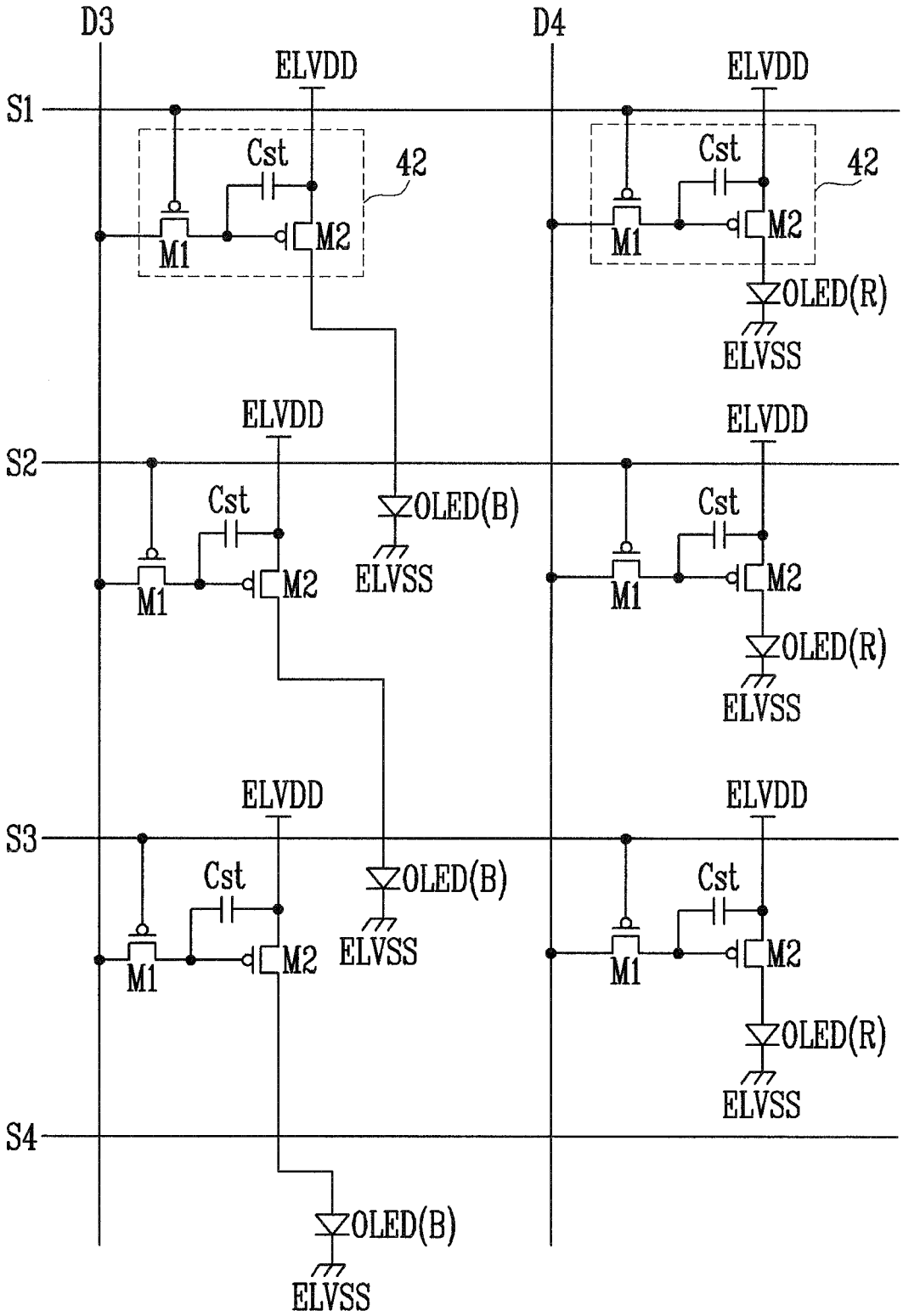
FIG. 2 shows a schematic circuit diagram of pixels shown in FIG. 1 in detail.

FIG. 2 shows an embodiment of the pixel circuits 42 shown in FIG. 1. Hereinafter, one of the pixel circuits 42 will be described using sub-pixels coupled to the first scan line S1 and the third data line D3.

Referring to FIG. 2, the pixel circuit 42 included in each of the sub-pixels includes a first transistor M1 that is turned on when a scan signal is supplied to the scan line S1 to provide a data signal supplied from the data line D3, a storage capacitor Cst for charging a voltage corresponding to the data signal, and a second transistor M2 for supplying a current to an organic light emitting diode OLED(B) and being turned on or off corresponding to the voltage charged into the storage capacitor Cst.

A gate electrode of the first transistor M1 is coupled to the scan line S1, and a first electrode of the first transistor M1 is coupled to the data line D3. A second electrode of the first transistor M1 is coupled to one terminal of the storage capacitor Cst. Here, the first electrode of the first transistor M1 is set as any one of source and drain electrodes, and the second electrode of the first transistor M1 is set as the other electrode different from the first electrode. For example, when the first electrode is set as a source electrode, the second electrode is set as a drain electrode. When a scan signal (e.g., a low level signal) is supplied from the scan line S1, the first transistor M1 coupled to the scan line S1 and the data line D3 is turned on to supply a data signal supplied from the data line D3 to the storage capacitor Cst. At this time, a voltage corresponding to the data signal is charged into the storage capacitor Cst.

A gate electrode of the second transistor M2 is coupled to one terminal of the storage capacitor Cst, and a first electrode of the second transistor M2 is coupled to the other terminal of the storage capacitor Cst and the first power ELVDD. A second electrode of the second transistor M2 is coupled to an anode electrode of the organic light emitting diode OLED(B). The second transistor M2 controls whether or not a current is supplied to the second power ELVSS via the organic light emitting diode OLED(B) from the first power ELVDD, and being turned on or off corresponding to a voltage value stored in the storage capacitor Cst.

Figure 3A:
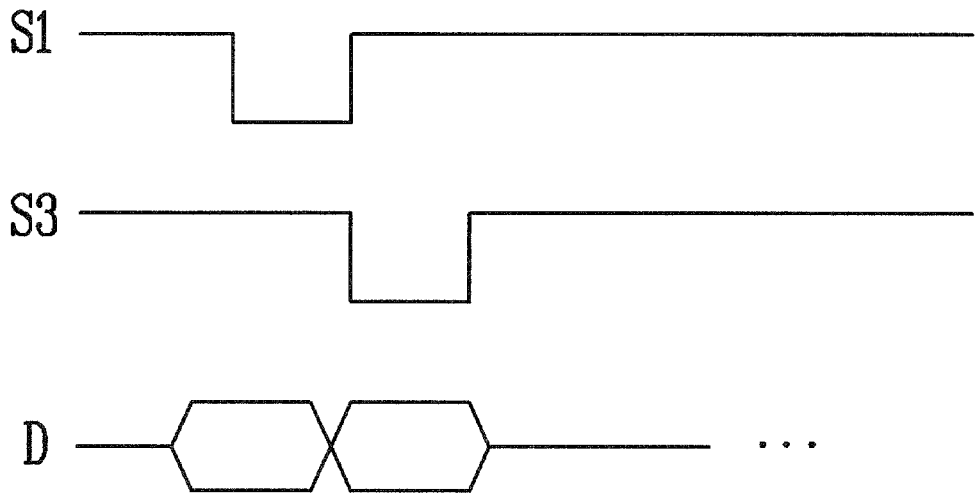
FIGS. 3A and 3B are waveform diagrams illustrating a method of driving the organic light emitting display of FIG. 1.
Figure 3B:
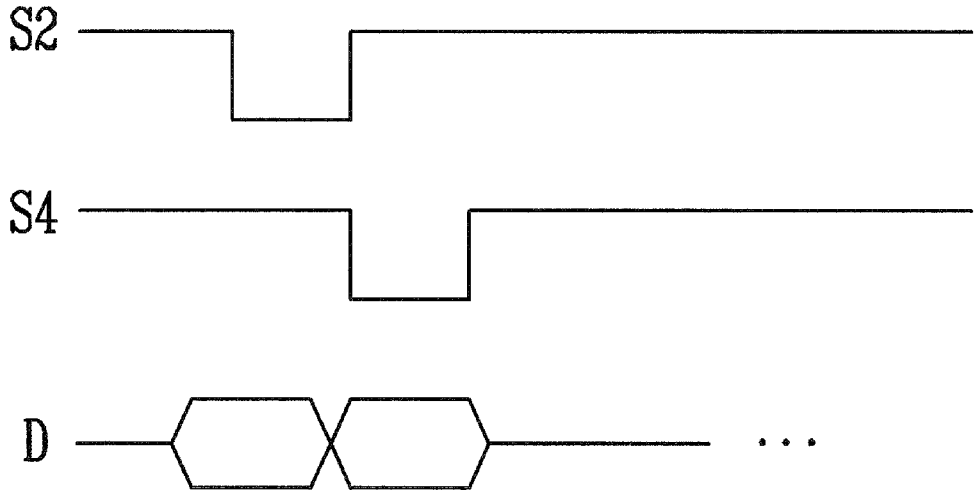

FIGS. 3A and 3B are waveform diagrams showing scan signals supplied to scan lines.

Referring to FIGS. 3A and 3B, a scan signal is sequentially supplied to the odd-numbered scan lines S1, S3, etc. during a scan period of a sub-frame. When a scan signal is supplied to the odd-numbered scan lines S1, S3, etc., a data signal is supplied to pixels 40 coupled to the odd-numbered scan lines S1, S3, etc., and therefore, the pixels 40 coupled to the odd-numbered scan lines S1, S3, etc. emit or do not emit light in response to the data signal.

Figure 4A:
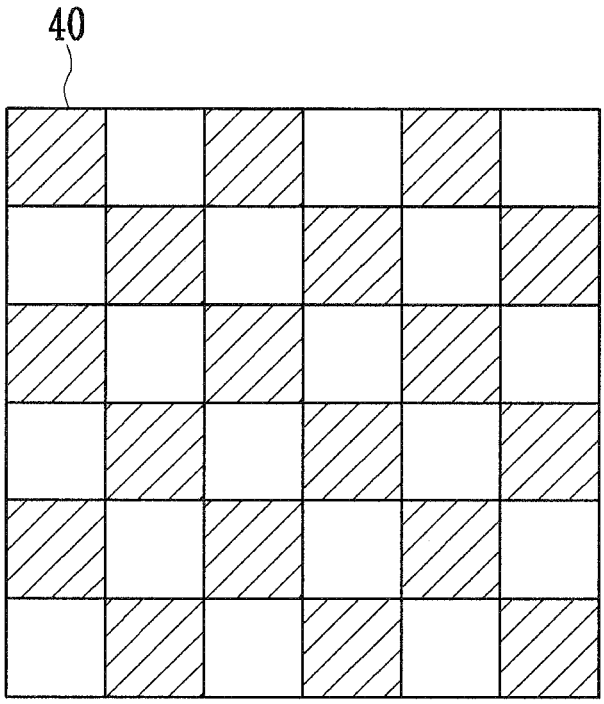
FIGS. 4A and 4B are drawings that show pixels emitting light in a mosaic form by the driving waveforms of FIGS. 3A and 3B, respectively.

For example, when a first data signal is supplied to all the odd-numbered scan lines S1, S3, etc., light is emitted in a mosaic form as shown in FIG. 4A. In other words, since organic light emitting diodes OLEDs of the pixels 40 coupled to the odd-numbered scan lines S1, S3, etc. are alternately positioned on different horizontal lines for pixels coupled to a same scan line, light is emitted in a mosaic form in the display unit 30.

Thereafter, a scan signal is sequentially supplied to the even-numbered scan lines S2, S4, . . . during a scan period of a sub-frame after a time interval of about ½ frame. When a scan signal is supplied to the even-numbered scan lines S2, S4, etc., a data signal is supplied to pixels 40 coupled to the even-numbered scan lines S2, S4, etc., and therefore, the pixels 40 coupled to the even-numbered scan lines S2, S4, etc. emit or do not emit light in response to the data signal.

Figure 4B:
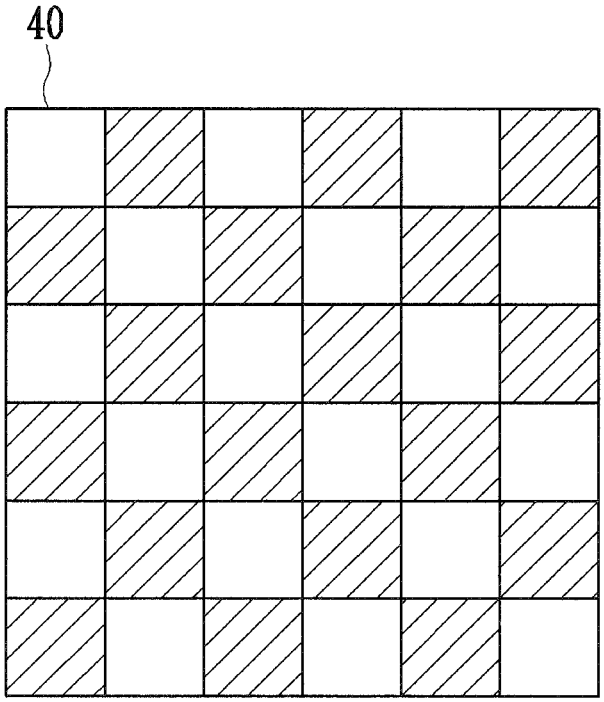

For example, when the first data signal is supplied to all the even-numbered scan lines S2, S4, etc., light is emitted in a mosaic form as shown in FIG. 4B. In other words, since organic light emitting diodes OLEDs of the pixels 40 coupled to the even-numbered scan lines S2, S4, etc. are positioned on different horizontal lines for pixels coupled to a same scan line, light is emitted in a mosaic form in the display unit 30.

As described above, in the present invention, organic light emitting diodes OLED of a specific pixel 40 and a pixel 40 adjacent to the left/right of the specific pixel 40 are arranged to be positioned on different horizontal lines, so that light is emitted in a mosaic form. If light is emitted in such a mosaic form, it is possible to prevent or reduce line-shaped noise from being generated.

According to embodiments of the present invention, various methods may be used to provide a display unit 30 such that a pixel circuit 42 coupled to the i-th scan line Si is coupled to an organic light emitting diode OLED positioned in the (i+1)-th horizontal line. For example, a source/drain metal of the pixel circuit 42 coupled to the i-th scan line Si may be electrically coupled (e.g., via a contact hole) to an anode electrode of the organic light emitting diode OLED positioned in the (i+1)-th horizontal line.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display comprising:

a scan driver for supplying a scan signal to scan lines;

a data driver for supplying a data signal to data lines; and pixels coupled to the scan lines and the data lines, each of the pixels having a corresponding one of organic light emitting diodes (OLEDs), wherein the OLEDs of first pixels and second pixels of said pixels coupled to a first scan line of the scan lines are alternately positioned in a first horizontal line and a second horizontal line adjacent to the first horizontal line, respectively, and third pixels of said pixels coupled to a second scan line of the scan lines are positioned in the first horizontal line, and wherein both the first horizontal line and the second horizontal line are located at a same side of the first scan line.

2. The organic light emitting display as claimed in claim 1, wherein, the data driver is configured to supply the data signal corresponding to the first horizontal line to corresponding data lines of the data lines coupled to the first pixels, and supply the data signal corresponding to the second horizontal line to corresponding data lines of the data lines coupled to the second pixels when the scan signal is supplied to the first scan line.

3. The organic light emitting display as claimed in claim 2, further comprising a timing controller for rearranging received data and supplying the rearranged data to the data driver so that the data signal corresponding to the first horizontal line and the data signal corresponding to the second horizontal line are supplied from the data driver in accordance with the rearranged data.

4. The organic light emitting display as claimed in claim 2, wherein the data signal is a first data signal with which the pixels emit light or a second data signal with which the pixels do not emit light.

5. The organic light emitting display as claimed in claim 1, wherein a source/drain metal of a driving transistor included in each of the first pixels for supplying a current to a corresponding one of the organic light emitting diodes is electrically coupled to an anode electrode of the organic light emitting diode positioned in the first horizontal line through a contact hole.

6. The organic light emitting display as claimed in claim 1, wherein each of the pixels comprises a red sub-pixel having a red organic light emitting diode among the OLEDs, a green sub-pixel having a green organic light emitting diode among the OLEDs, and a blue sub-pixel having a blue organic light emitting diode among the OLEDs.

7. The organic light emitting display as claimed in claim 1, wherein the scan lines comprise odd-numbered scan lines and even-numbered scan lines, which are driven at a time difference of ½ frame.

8. A method of driving an organic light emitting display having pixels coupled to data lines and scan lines, each of the pixels having an organic light emitting diode, the method comprising:

while supplying a first scan signal to a first scan line of the scan lines, supplying a first data signal to first pixels of the pixels that are coupled to the first scan line and have their organic light emitting diodes (OLEDs) positioned on a first horizontal line;

while supplying the first scan signal to the first scan line, supplying second data signal to second pixels of the pixels that are coupled to the first scan line and have their OLEDs positioned on a second horizontal line adjacent to the first horizontal line, both the first horizontal line and the second horizontal line being located at a same side of the first scan line; and while supplying a second scan signal to a second scan line of the scan lines, supplying a third data signal to third pixels of the pixels that are coupled to the second scan line and have their OLEDs positioned in the first horizontal line.

9. The method as claimed in claim 8, wherein the OLEDs of the first pixels and the OLEDs of the second pixels are alternately arranged between the first horizontal line and the second horizontal line.

10. The method as claimed in claim 9, wherein the data signal is a first data signal with which the pixels emit light or a second data signal with which the pixels do not emit light.

11. The method as claimed in claim 8, wherein each of the pixels comprises a red sub-pixel having a red organic light emitting diode, a green sub-pixel having a green organic light emitting diode, and a blue sub-pixel having a blue organic light emitting diode.

12. The method as claimed in claim 8, wherein one frame is divided into a plurality of sub-frames, and the scan lines comprise odd-numbered scan lines and even-numbered scan lines, which are driven at a time difference of ½ frame.

13. A method of driving an organic light emitting display having a plurality of pixels coupled to scan lines and data lines, the method comprising:

supplying a first scan signal to a first scan line of the scan lines coupled to first and second pixels of the pixels;

supplying a first data signal to first pixels of the pixels, each of the first pixels having at least one first organic light emitting diode (OLED) positioned on a first horizontal line;

supplying a second data signal to second pixels of the pixels, each of the second pixels having at least one second OLED positioned on a second horizontal line adjacent to the first horizontal line, both the first horizontal line and the second horizontal line being located at a same side of the scan line; and supplying a third data signal to third pixels of the pixels coupled to a second scan line, each of the third pixels having at least one third OLED positioned on the first horizontal line.

14. The method of claim 13, wherein a pixel of the plurality of pixels comprises sub-pixels, and each of the sub-pixels has an organic light emitting diode positioned on a same horizontal line.

* * * * *

UNITED STATES PATENT AND TRADEMARK OFFICE

CERTIFICATE OF CORRECTION

PATENT NO. : 8,552,934 B2
APPLICATION NO. : 12/424299
DATED : October 8, 2013
INVENTOR(S) : Wang-Jo Lee et al.

It is certified that error appears in the above-identified patent and that said Letters Patent is hereby corrected as shown below:

In the Claims

| | |
|---|---|
| Col. 6, line 59, Claim 2 | Delete "wherein,",<br>Insert --wherein-- |
| Col. 7, line 37, Claim 8 | Delete "supply second",<br>Insert --supply a second-- |

Signed and Sealed this
Twenty-fourth Day of February, 2015

Michelle K. Lee

Michelle K. Lee
*Deputy Director of the United States Patent and Trademark Office*